US007641416B2

(12) United States Patent
Miracle

(10) Patent No.: US 7,641,416 B2
(45) Date of Patent: Jan. 5, 2010

(54) VEHICLE BARRIER DEPLOYMENT SYSTEM

(76) Inventor: Gary Dale Miracle, 7685 Old Woods Ct., Springboro, OH (US) 45066

( * ) Notice: Subject to any disclaimer, the term of this patent is extended or adjusted under 35 U.S.C. 154(b) by 0 days.

(21) Appl. No.: 11/742,648

(22) Filed: May 1, 2007

(65) Prior Publication Data

US 2007/0264080 A1 Nov. 15, 2007

Related U.S. Application Data

(60) Provisional application No. 60/799,439, filed on May 10, 2006.

(51) Int. Cl.
*E01F 13/00* (2006.01)

(52) U.S. Cl. ..... 404/6; 49/9; 49/49; 49/133

(58) Field of Classification Search ..... 404/6, 404/9, 10, 11, 25; 49/131, 133, 49, 9, 263; 256/13.1

See application file for complete search history.

(56) References Cited

U.S. PATENT DOCUMENTS

| | | | | | |
|---|---|---|---|---|---|
| 1,403,750 | A | * | 1/1922 | Donovan | 49/9 |
| 3,079,711 | A | * | 3/1963 | Turner | 49/49 |
| 3,128,972 | A | * | 4/1964 | Fonden et al | 244/110 R |
| 3,468,500 | A | * | 9/1969 | Carlsson | 244/110 R |
| 3,738,599 | A | * | 6/1973 | Borehag | 244/110 C |
| 3,810,595 | A | * | 5/1974 | Doolittle | 244/110 C |
| 4,004,857 | A | * | 1/1977 | Eschen, Jr. | 404/6 |
| 4,138,095 | A | | 2/1979 | Humphrey | |
| 4,152,871 | A | * | 5/1979 | Kardash, Jr. | 49/49 |
| 4,312,600 | A | | 1/1982 | Schaaf | |
| 4,438,596 | A | | 3/1984 | Jones | |
| 4,465,262 | A | | 8/1984 | Itri | |
| 4,490,068 | A | * | 12/1984 | Dickinson | 404/6 |
| 4,502,812 | A | | 3/1985 | Zucker | |
| 4,554,695 | A | | 11/1985 | Rowland | |
| 4,574,523 | A | | 3/1986 | Nasatka | |
| 4,576,508 | A | | 3/1986 | Dickinson | |
| 4,577,991 | A | | 3/1986 | Rolow | |
| 4,630,395 | A | | 12/1986 | Nasatka | |
| 4,666,331 | A | | 5/1987 | Riley | |
| 4,705,426 | A | | 11/1987 | Perea | |

(Continued)

OTHER PUBLICATIONS

Screenshots from www.roboticsecuritysystems.com, printed Apr. 17, 2007.

*Primary Examiner*—Gary S Hartmann
(74) *Attorney, Agent, or Firm*—Frost Brown Todd LLC

(57) ABSTRACT

A vehicle barrier deployment system comprises a base member, at least two lifting members, at least one barrier member, and an actuation assembly. The lifting members are pivotally secured to the base member, and are operable to be selectively raised and lowered in a vertical direction relative to the base member. The at least one barrier member is in communication with the lifting members, and is configured to stop a moving vehicle when the lifting members are in a raised position. The actuation assembly is in communication with the lifting members, and is operable to selectively raise and lower the lifting members by moving at least a portion of each of the lifting members in a direction transverse to a traffic lane. The barrier member may comprise chains, a guardrail, or other structures. The system may be mobile or may be fixed (e.g., embedded in ground) in a particular location.

15 Claims, 7 Drawing Sheets

U.S. PATENT DOCUMENTS 4,711,608 A 12/1987 Ghusn
4,715,742 A 12/1987 Dickinson
4,818,136 A 4/1989 Nasatka
4,826,349 A 5/1989 Nasatka
4,850,737 A * 7/1989 Nasatka et al. ..... 404/6
4,852,511 A 8/1989 Look
4,861,185 A 8/1989 Eikelenboon
4,964,750 A 10/1990 House
5,030,029 A 7/1991 Johnsen
5,050,846 A 9/1991 Goodman
5,123,773 A 6/1992 Yodock
5,131,786 A 7/1992 House
5,215,399 A 6/1993 Berger
5,228,237 A 7/1993 Nasatka
5,245,787 A * 9/1993 Swenson et al. ..... 49/34
5,248,215 A 9/1993 Fladung
5,288,164 A 2/1994 Nasatka
5,297,921 A * 3/1994 Springer et al. ..... 414/401
5,336,033 A * 8/1994 Alexander ..... 414/401
5,346,353 A * 9/1994 Alexander ..... 414/401
5,466,088 A * 11/1995 Nasatka ..... 404/6
5,544,614 A 8/1996 Cushman
5,605,413 A 2/1997 Brown
5,626,330 A 5/1997 Young
5,640,806 A 6/1997 Hall
5,711,110 A 1/1998 Williams
5,775,833 A * 7/1998 Little ..... 404/9
5,809,733 A 9/1998 Venegas
5,871,038 A * 2/1999 Gompertz et al. ..... 160/328
5,895,169 A 4/1999 Holm
5,975,791 A 11/1999 McCulloch
5,987,616 A 11/1999 Suzuki
6,071,037 A 6/2000 Holt
6,099,200 A 8/2000 Pepe
6,116,805 A 9/2000 Gertz
6,135,190 A * 10/2000 Gompertz et al. ..... 160/328
6,145,571 A 11/2000 Snyder
6,149,338 A 11/2000 Anderson
6,158,696 A 12/2000 Brodskiy
6,312,188 B1 * 11/2001 Ousterhout et al. ..... 404/6
6,322,285 B1 11/2001 Ben
6,349,503 B1 * 2/2002 Gompertz et al. ..... 49/34
6,367,781 B1 4/2002 Flynn
6,382,870 B1 5/2002 Gertz
6,578,342 B2 6/2003 Faynor
6,662,520 B1 12/2003 Nelson
6,709,190 B1 3/2004 Partin
6,769,833 B2 8/2004 Dicke
6,817,805 B2 11/2004 Mettler
6,836,222 B1 12/2004 Carini
6,866,252 B2 3/2005 Pulliam
6,951,434 B2 10/2005 Yodock
7,195,422 B2 * 3/2007 Hannah ..... 404/11
2005/0220536 A1 * 10/2005 Blair et al. ..... 404/6
2005/0232740 A1 * 10/2005 Cummings ..... 414/680
2007/0183845 A1 * 8/2007 Lewis ..... 404/6
2007/0237577 A1 * 10/2007 Gelfand et al. ..... 404/6

* cited by examiner

VEHICLE BARRIER DEPLOYMENT SYSTEM

PRIORITY

This application claims priority from the disclosure of U.S. Provisional Patent Application Ser. No. 60/799,439, entitled "Vehicle Barrier Deployment System," filed May 10, 2006, the disclosure of which is incorporated by reference herein in its entirety.

BACKGROUND

Embodiments of the present invention relate to systems and devices that may be used to provide a barrier to prevent the passage of vehicles and the like. Some barriers may be installed in a fixed configuration, such that the barrier system constantly prevents the passage of vehicles and the like. Other barriers may be selectively deployable, such that vehicles may pass during selected times (e.g., when the barrier is present but not deployed); while vehicles may be prevented from passing during other selected times (e.g., when the barrier is deployed). While a variety of systems and methods have been made and used to provide a barrier, it is believed that no one prior to the inventor has made or used the invention described in the appended claims.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

Figure 1:
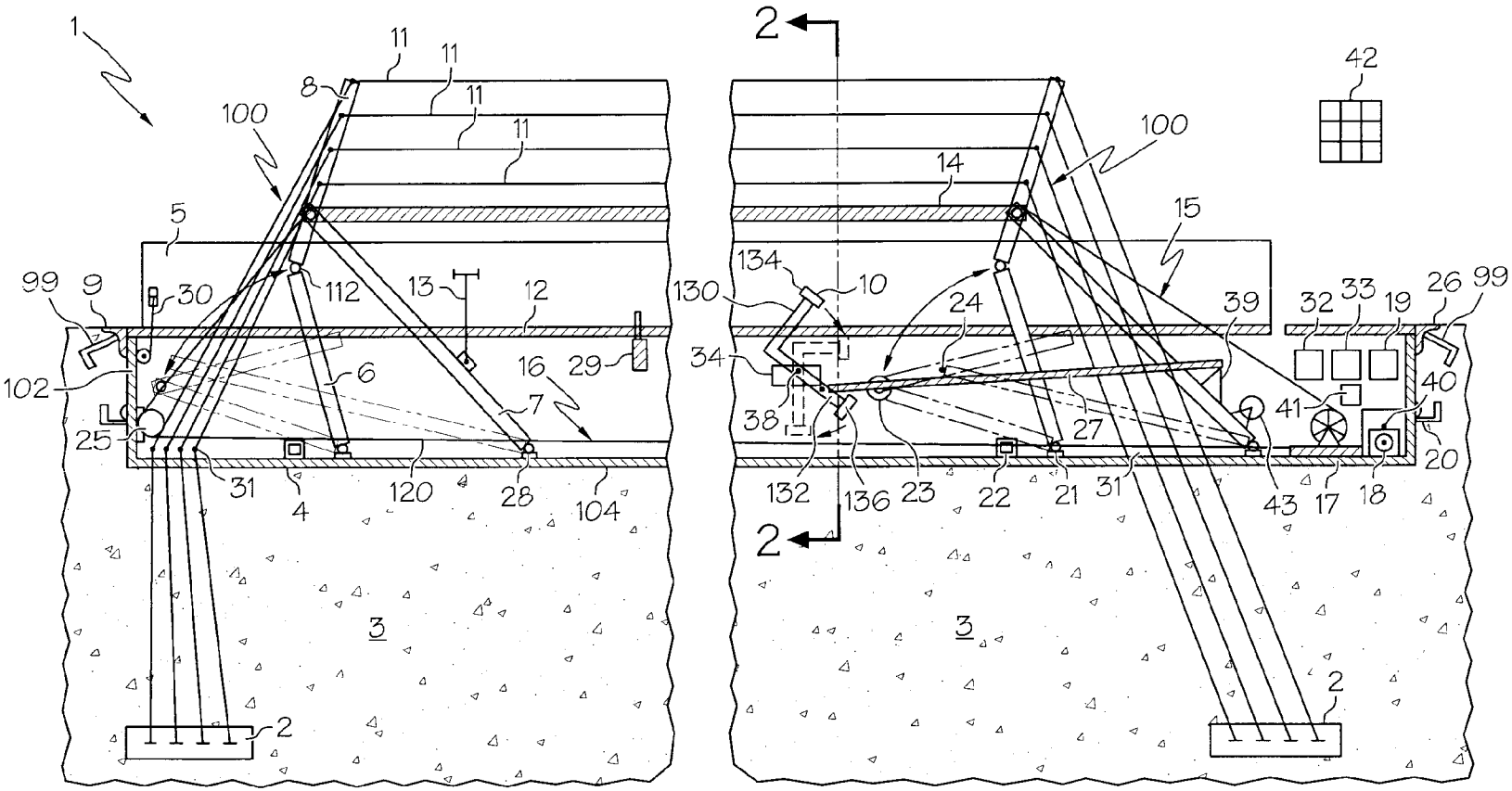
FIG. 1 depicts a cross-sectional view, taken along a longitudinal plane, of an exemplary vehicle barrier deployment system.
Figure 2:
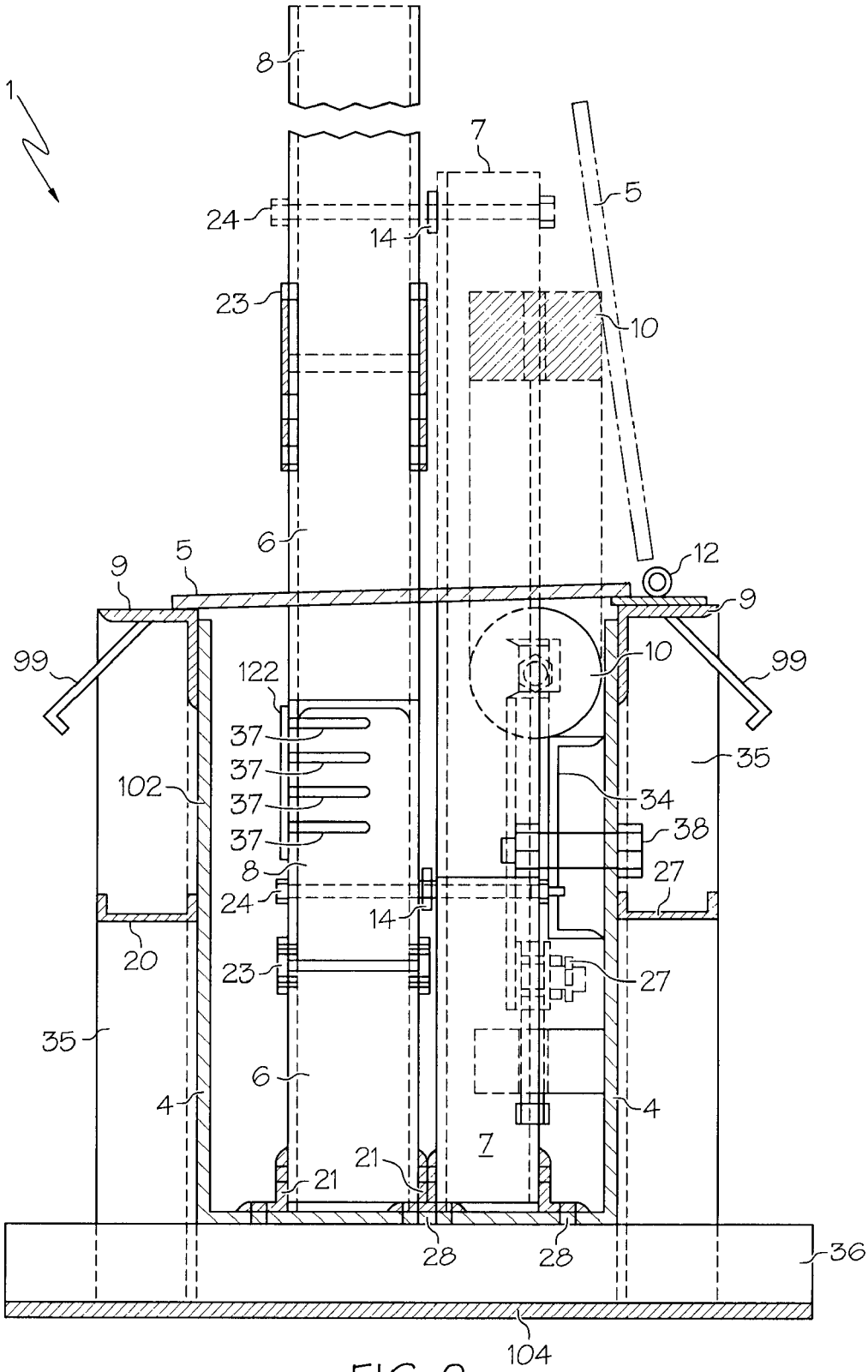
FIG. 2 depicts a cross-sectional view of the vehicle barrier deployment system of FIG. 1, taken along line 2-2 of FIG. 1.

As shown in FIGS. 1-2, an exemplary vehicle barrier deployment system (1) comprises a housing (4) embedded within reinforced concrete (3). As shown, the housing (4) comprises a hinged cover plate (5) and a pair of folding deployment posts (100). It will be appreciated, however, that any other suitable number of folding deployment posts (100) may be used. A plurality of chains (11) are engaged with each folding deployment post (100). As will be described in greater detail below, deployment posts (100) are operable to fold into housing (4), such that cover plate (5) may substantially close deployment posts (100) within housing (4). As will also be described in greater detail below, when hinged cover plate (5) is opened, deployment posts (100) may extend upwardly and unfold to a deployed configuration. With deployment posts (100) in a deployed configuration, chains (11) are configured to provide a barrier against passage of vehicles and the like. Vehicle barrier deployment system (1) may therefore be provided within a road or elsewhere to selectively prevent passage of vehicles and the like. In certain embodiments, vehicle barrier deployment system (1) may stop a vehicle that is traveling at a high rate of speed, even if the driver of the vehicle is intent on passing through the barrier provided by vehicle barrier deployment system (1).

Housing (4) of the present example comprises sidewalls (102) and a floor (104). A plurality of electrical components are provided within housing (4), including an electrical junction box (19), a transformer (32), a DC/AC inverter (33), a battery (40), a battery charger (41), a solar panel (42), and a limit switch (43). These components provide electricity to other components within housing (4), as will be described in greater detail below. In one embodiment, battery (40) is rechargeable by solar power via solar panel (42). In another embodiment, battery (40) is omitted, and an external power line is fed to housing (4). It will be appreciated, therefore, that a variety of alternative components may be used to provide and/or regulate electricity to other components within housing (4). It will also be appreciated that, in some embodiments, vehicle barrier deployment system (1) may be modified such that no electricity is required at all. In another variation, vehicle barrier deployment system (1) may be modified such that no external electricity is required for deployment. Referring back to FIG. 1, a sump pump (18) is provided within housing (4) to purge water from housing (4). Of course, as with various other components described herein, sump pump (18) is merely optional.

Figure 4:
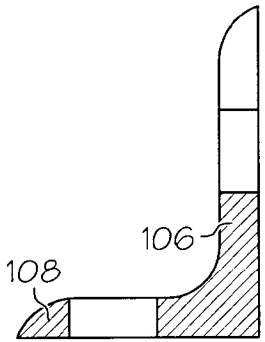
FIG. 4 depicts a cross-sectional view of the shear bearing joint of FIG. 3, taken along line 4-4 of FIG. 3.
Figure 3:
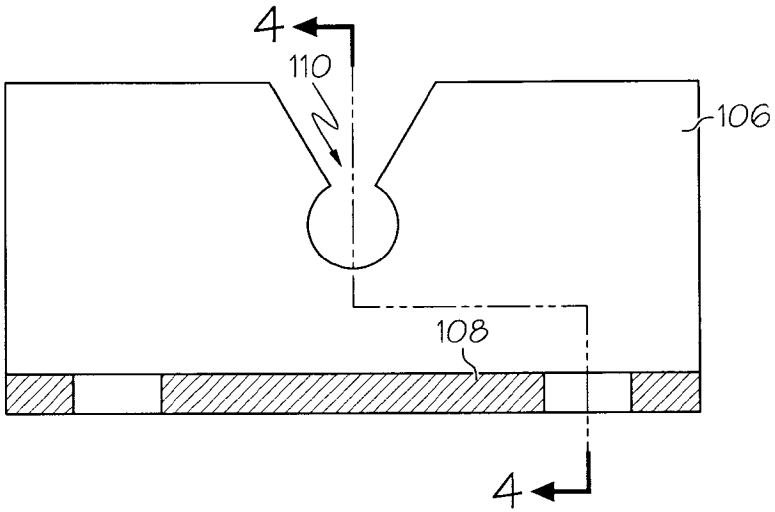
FIG. 3 depicts a cross-sectional view, taken along a longitudinal plane, of an exemplary shear bearing joint that may be used in the vehicle barrier deployment system of FIG. 1.
Figure 5:
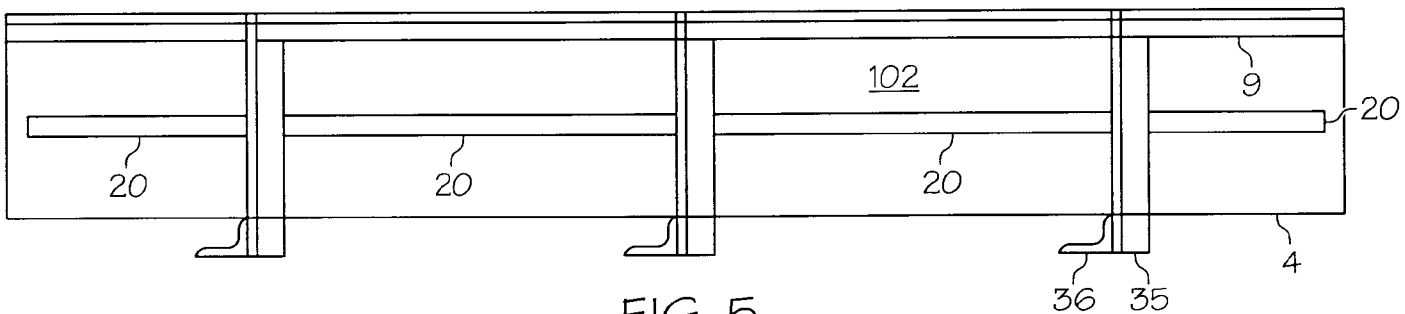
FIG. 5 depicts a side view of the housing of the vehicle barrier deployment system of FIG. 1.

Each deployment post (100) comprises a lower portion (6) and an upper portion (8) that are connected at a pivot joint (112). Lower portion (6) of each deployment post (100) is mounted to floor (104) of housing (4) at a shear bearing joint (21). As further illustrated in FIGS. 3-4, each shear bearing joint (21, 28) comprises a vertical plate (106) and a horizontal flange (108). Horizontal flange is mounted to floor (104) of housing (4) using bolts, any other suitable fastener, welding, or any other suitable means. Vertical plate (106) comprises a breakaway opening (110) configured to receive a bolt, pin, or other structure to provide pivotal engagement with lower portion (6) of deployment post (100). Of course, pivotal engagement of lower portion (6) and floor (104) of housing (4) may be provided by any suitable alternative to shear bearing joint (21).

As will be described in greater detail below, breakaway opening (110) of the present example is configured to permit lower portion (6) of deployment post (100) to break away from floor (104) of housing (4) when chains (11) are subject to a sudden and substantial impulse of force, such as upon impact of a moving vehicle with chains (11). Vehicle barrier deployment system (1) may further comprise one or more sensors (not shown) configured to detect when a deployment post (100) has been broken away from floor (104), or to otherwise detect a vehicle striking at least a portion of vehicle barrier deployment system (1), such that a vehicle strike may be communicated to a remote location as described in greater detail below. In alternative embodiments, lower portion (6) and floor (104) of housing (4) are engaged in a manner such that deployment posts (100) do not easily break away from floor (104) of housing (4) when chains (11) are subject to a sudden and substantial impulse of force.

A resting block (22) is mounted to floor (104) of housing (4) for each deployment post (100). In particular, when vehicle barrier deployment system (1) is in a non-deployed configuration, such that deployment posts (100) are folded within housing (4), lower portion (6) of each deployment post (100) rests on its corresponding resting block (22). It will therefore be appreciated that, even when vehicle barrier deployment system (1) is in a non-deployed configuration, lower portion (6) of each deployment post (100) does not rest on floor (104) of housing (4). Alternatively, resting blocks (22) may be substituted with any alternative structure, or they may be omitted altogether (e.g., where lower portions (6) are curved instead of being straight, or under other circumstances).

The upper portion (8) of each deployment post (100) is pivotally secured to an end of a respective brace (7) by a pin (24). The opposing end of each brace (7) is pivotally secured to floor (104) of housing (4) at a respective shear bearing joint (28). As described above with respect to the connection between lower portion (6) of each deployment post (100) and corresponding shear bearing joints (21), and as will be described in greater detail below, each shear bearing joint (28) is configured to permit its corresponding brace (7) to break away from floor (104) of housing (4) when chains (11) are subject to a sudden and substantial impulse of force, such as upon impact of a moving vehicle with chains (11). Of course, pivotal engagement of brace (7) and floor (104) of housing (4) may be provided by any suitable alternative to shear bearing joint (21). Similarly, brace (7) and floor (104) of housing (4) may alternatively be engaged in a manner such that braces (7) do not easily break away from floor (104) of housing (4) when chains (11) are subject to a sudden and substantial impulse of force.

The upper portion (8) of each deployment post (100) in the present example is also pivotally secured to a deployment bar (14). While deployment bar (14) is shown as being secured to each upper portion (8) at approximately the same location as each corresponding brace (7), it will be appreciated that deployment bar (14) may be secured to each upper portion (8) at any other suitable location along upper portion (8). In the present example, deployment bar (14) is configured to transmit force from one upper portion (8) to another upper portion (8). Of course, any other structures or techniques may be used to transmit force from one upper portion (8) to another upper portion (8), to the extent that such force transmission is desired.

In the present example, a winch (17) is also provided within housing (4), and is secured to floor (104) of housing (4). To receive power, winch (17) of the present example is in electrical communication with the electrical components described above. Winch (17) is in mechanical communication with a cable (120). Cable (120) comprises a post deploying portion (15) and a post retraction portion (16). The free end of post deploying portion (15) is secured to brace (7) of one deployment post (100); while the free end of post retraction portion (16) is secured to brace (7) of another deployment post (100). A pulley (25) is provided on sidewall (102), and post retraction portion (16) of cable (120) is fed around pulley (25) before reaching upper portion (8) of deployment post (100).

As will be appreciated by those of ordinary skill in the art, and with reference to FIG. 1 in particular, as winch (17) rotates clockwise, such rotation causes post deploying portion (15) of cable (120) to get shorter and post retraction portion (16) to get longer. In one embodiment, rotation of winch (17) (e.g., in the clockwise and/or counterclockwise direction) is regulated by one or more limit switches (43), though any other suitable components my be used. As will also be appreciated by those of ordinary skill in the art, such shortening of post deploying portion (15) will effect a pulling of the upper portion (8) of the closest deployment post (100) toward winch (17). Given the pivotal relationship between upper portion (8) and lower portion (6) of deployment post (100), and given the pivotal relationship between lower portion (6) of deployment post (100) and floor (104), and also given the presence of brace (7), it will be appreciated that such pulling will cause deployment post (100) to deploy from a folded configuration within housing (4) to an extended and deployed configuration, such that deployment post (100) will be pulled to a substantially upright position. In another embodiment, one or more tension pulleys (not shown) or some other structure(s) are included to maintain tension in cable (120) at any suitable location(s). Of course, it will be immediately apparent to those of ordinary skill in the art that deployment posts (100) may be deployed in any other suitable fashion using any other suitable components, and that such deployment does not necessarily require each and every one of the components described herein for such deployment, nor the particular relationships between such components as described herein for such deployment.

In the present example, given the pivotal connection of deployment bar (14) to each deployment post (100), it will be appreciated that, as deployment post (100) that is closest to winch (17) is deployed upon pulling by post deploying portion (15) of cable (120), a pulling force will be transferred to other deployment posts (100) via deployment bar (14). In other words, where a first deployment post (100) in a series is pulled to a deployed configuration by cable (120), other deployment posts (100) in the series may be correspondingly pulled to a deployed configuration by deployment bar (14). Deployment bar (14) may also maintain a proper distance between deployment posts (100) during movement for uniform raising and lowering. In another embodiment, deployment bar (14) is substituted with one or more cables (not shown) or any other suitable structure(s). Alternatively, multiple deployment posts (100) within a series of deployment posts (100) may be extended to a deployed configuration using any other suitable structures, devices, or techniques.

Referring again to FIG. 1, when winch (17) is rotated counterclockwise, such rotation in the present example will cause post retraction portion (16) of cable (120) to get shorter and post deploying portion (15) to get longer. As noted above, rotation of winch (17) (e.g., in the clockwise and/or counterclockwise direction) may be regulated by one or more limit switches (43) or any other suitable component(s). As will also be appreciated by those of ordinary skill in the art, such shortening of post retraction portion (16) will effect a pulling of the upper portion (8) of the deployment post (100) that is farthest from winch (17). Given the pivotal relationship between upper portion (8) and lower portion (6) of deployment post (100), and given the pivotal relationship between lower portion (6) of deployment post (100) and floor (104), and also given the presence of brace (7), it will be appreciated that such pulling will cause deployment post (100) to "undeploy" or retract from an extended and deployed configuration to a folded configuration within housing (4), such that deployment post (100) will be pulled to a substantially retracted position with lower portion (6) resting against block (22). Of course, it will be immediately apparent to those of ordinary skill in the art that deployment posts (100) may be "undeployed" or retracted in any other suitable fashion using any other suitable components, and that such retraction does not necessarily require each and every one of the components described herein for such retraction, nor the particular relationships between such components as described herein for such retraction.

In the present example, given the pivotal connection of deployment bar (14) to each deployment post (100), it will be appreciated that, as deployment post (100) that is farthest from winch (17) is retracted upon pulling by post retraction portion (16) of cable (120), a pulling force will be transferred to other deployment posts (100) via deployment bar (14). In other words, where a first deployment post (100) in a series is pulled to a retracted configuration by cable (120), other deployment posts (100) in the series may be correspondingly pulled to a retracted configuration by deployment bar (14). Alternatively, multiple deployment posts (100) within a series of deployment posts (100) may be placed in a folded or otherwise retracted configuration using any other suitable structures, devices, or techniques. It will also be appreciated that the location of winch (17) and the direction of winch (17) rotation to effect deployment and retraction may be varied in any suitable fashion. In other words, the location of winch (17) and the direction of winch (17) rotation to effect deployment and retraction as described herein is merely exemplary, and is not intended to be limiting in any way.

As noted above, vehicle barrier deployment system (1) of the present example comprises a plurality of chains (11). By way of example only, chains (11) may comprise links (not shown) that are formed of material (e.g., steel, etc.) that is approximately a half-inch thick, though any other suitable dimension or material(s) may be used. Each end of each chain (11) is secured to an anchor (2) within reinforced concrete (3). With anchors (2) being located external to housing (4), each chain (11) passes through a chain exit opening (31) formed through floor (104) of housing (4). In another embodiment, chain exit openings (31) are formed through sidewall (102) of housing (4). In still other embodiments, chains (11) are anchored directly to floor (104), to some other component that is secured to floor (104), directly to sidewalls (102), or to some other component that is secured to sidewalls (102). Other suitable structures and techniques for securing chains (11) will be apparent to those of ordinary skill in the art.

Upper portion (8) of each deployment post (100) has a plurality of chain engagement notches (37). As shown in FIG. 2, chain engagement notches (37) are provided as lateral slots formed in upper portion (8). Chain engagement notches (37) are configured such that a link of chain (11) may be slid into chain engagement notch (37), whereupon the link of chain (11) will be substantially prevented from rotating by chain engagement notch (37). Furthermore, chain engagement notch (37) is configured such that neither link that is adjacent to the link that is inserted in chain engagement notch (37) may pass through chain engagement notch (37). In other words, once a link of a chain (11) is inserted into a chain engagement notch (37), the chain (11) may not be pulled through that chain engagement notch (37) in either longitudinal direction of the chain (11). When the desired number of chains (11) have been inserted into the chain engagement notches (37) of an upper portion (8), a chain retention member (122) is secured to upper portion (8) to prevent chain (11) from sliding laterally out from chain engagement notch (37). Of course, as an alternative, a chain (11) may be secured to any suitable portion of a deployment post (100) using any other suitable structures or techniques.

It will be appreciated that, as deployment posts (100) are moved from a retracted, folded configuration to a deployed, upright configuration, chains (11) may move with deployment posts (100). Accordingly, when deployment posts (100) are in a retracted, folded configuration within housing (4), chains (11) may also be located substantially within housing (4). Similarly, when deployment posts (100) are in a deployed, upright configuration, chains (11) may be thereby extended from within housing (4). It will also be appreciated that any suitable alternative to chains (11) may be used. By way of example only, a substitute or supplement for chains (11) may include cables, rods, bars, rails, ropes, netting, plates, or any other suitable structures, including combinations of such structures, and including any suitable material or combination of materials.

As noted above, cover plate (5) is pivotally engaged relative to sidewall (102) of housing (4), such that cover plate (5) may provide a selectively openable "lid" for vehicle barrier deployment system (1). In particular, cover plate (5) is mounted to a hinge (12), which is mounted to a curb angle (9). As will be described in greater detail below, curb angle (9) is secured to sidewall (102) of housing (4). A shown in FIG. 2, when cover plate (5) is down, cover plate (5) is configured to cover the opening defined by sidewalls (102) of housing (4). While a single, pivoting cover plate (5) is shown, it will be appreciated that cover plate (5) may be varied or modified in a number of ways. For instance, a pair of cover plates may be used, with each cover plate of the pair meeting in the middle of the opening defined by sidewalls (102), with a portion of one cover plate overlapping a portion of the other cover plate in the pair. In yet another embodiment where a pair of cover plates are used, each cover plate of the pair meets in the opening defined by sidewalls (102), with a portion of each cover plate in the pair being supported by a structural member located within the opening defined by sidewalls (102). Furthermore, cover plate (5) may be modified to slide open, to swing downward into housing (4), or to open in any other suitable way. Other variations of cover plate (5) and methods of opening cover plate (5) will be apparent to those of ordinary skill in the art.

As shown in FIGS. 1-2, a cover plate opening mechanism (10) is provided to open cover plate (5). Cover plate opening mechanism (10) comprises a first arm (130) and a second arm (132), which together define an angle providing stability for cover plate (5) opening. By way of example only, the angle defined by first arm (130) and second arm (132) may be approximately 90°, or any other suitable angle. A first roller (134) is secured to first arm (130), and a second roller (136) is secured to second arm (138). Second arm (138) is pivotally secured to a bracket (34) with a pin (38). Bracket (34) is secured to sidewall (102) of housing (4). Second arm (138) is also pivotally secured to a drive arm (27), which is engaged with brace (7) by a bracket (39). As described above, when winch (17) of the present example rotates clockwise to deploy deployment posts (100), brace (7) will rotate clockwise relative to floor (104) of housing (4) as deployment posts (100) are pulled upright to a deployed configuration. The engagement of drive arm (27) with brace (7) will cause drive arm (27) to be pulled as deployment posts (100) are pulled upright to a deployed configuration. Such pulling of drive arm (27) will effect pulling of second arm (132), which will in turn cause cover plate opening mechanism (10) to rotate counterclockwise (as shown in FIG. 1) about pin (38). This rotation of cover plate opening mechanism (10) will cause first roller (134) to push cover plate (5) open. Furthermore, when cover plate opening mechanism (10) is maintained in the rotated position (e.g., while deployment posts (100) are maintained in a deployed configuration), first roller (134) may continue to hold cover plate (5) in an open position. Second roller (136) may distribute at least a portion of the load to sidewall (102) as cover plate (5) is raised and held by first roller (134). Cover plate opening mechanism (10) and drive arm (27) are configured such that cover plate (5) may be opened in a manner sufficient to permit deployment posts (100) to be raised to an upright position without obstruction or interference by cover plate (5). Of course, cover plate opening mechanism (10) and drive arm (27) are merely exemplary, and any other suitable structures, devices, or techniques may be used to open cover plate (5). For instance, one or more lift assist springs (29), which are described in greater detail below with reference to FIGS. 6-7, may be added to this embodiment.

In the present example, a limiting chain (30) is secured to cover plate (5) and to sidewall (102). Limiting chain (30) is configured to restrict the degree to which cover plate (5) may be opened. In the present example, limiting chain (30) is configured to prevent cover plate (5) from opening to an angle greater than about 180° relative to sidewall (102), though any other suitable angle may be selected. Similarly, any suitable substitute, supplement, or variation for limiting chain (30) may be used.

A retraction chain (13) is also secured to cover plate (5), and is also secured to brace (7). In this example, as deployment posts (100) are pulled down from a deployed, upright position to a retracted, folded position by winch (17) and cable (120), brace (7) will pull cover plate (5) closed by pulling on retraction chain (13) and maintaining engagement with first roller (134) as it retracts and lowers cover plate (5) into a closed position. Alternatively, cover plate (5) may be closed using any other suitable structures, devices, or techniques. By way of example only, a spring or other resilient member may bias cover plate (5) to a closed position, such that upon clockwise rotation of cover plate opening mechanism (10) during retraction of deployment posts (100), cover plate (5) may be urged closed. Alternatively, limiting chain (30) may be configured such that its limit on the opening angle of cover plate (5) provides a gravitational bias of cover plate (5) to urge cover plate (5) closed upon clockwise rotation of cover plate opening mechanism (10) during retraction of deployment posts (100). Still other ways in which a cover plate (5) may be closed will be apparent to those of ordinary skill in the art.

As shown in FIGS. 1, 2, 5, and 7, housing (4) is provided with various structures for reinforcement. In particular, a curb angle (9) is secured at the top of the outside surface of each sidewall (102), such that curb angles (9) extend substantially along the length of each sidewall (102). Curb angles (9) are anchored within reinforced concrete (3) by a plurality of J-bolts (99). In addition, a horizontal stiffener member (20) is secured at the middle of the outside surface of each sidewall (102), such that horizontal stiffener members (20) extend substantially along the length of each sidewall (102). A plurality of vertical stiffener members (35) are also secured to the outer surface of each sidewall (102), such that each vertical stiffener member (35) extends substantially along the height of each sidewall (102). Furthermore, a plurality of horizontal stiffener members (36) are secured to pairs of vertical stiffener members (35) and extend along the width of the outer surface of floor (104). Accordingly, curb angles (9), horizontal stiffener members (20), vertical stiffener members (35), and horizontal stiffener members (36) together form a reinforcing external "skeleton" for housing (4). As with other components described herein, each of these components may be substituted, supplemented, relocated, or omitted in any suitable fashion as desired.

In one exemplary use, vehicle barrier deployment system (1) is provided in a roadway (26). In this example, housing (4) and anchors (2) are embedded within reinforced concrete (3). Housing (4) may have a length such that it extends across the width of roadway (26) to any suitable length (e.g., across one or more traffic lanes in roadway (26), across the entire width of roadway (26), etc.). To permit normal passage of traffic across roadway (26), deployment posts (100) may be kept in a retracted, folded configuration, and cover plate (5) may be kept in a closed configuration. By way of example only, when cover plate (5) is in a closed configuration, cover plate (5) may be substantially flush with the surface of roadway (26), such that vehicles driving along roadway (26) do not experience a substantial disturbance when driving over a closed vehicle barrier deployment system (1). When the provision of a barrier is desired, winch (17) may be activated to rotate clockwise (referring to FIG. 1), which will cause cover plate (5) to be opened and deployment posts (100) to be deployed as described above. When deployment posts (100) are deployed, deployment posts (100) and chains (11) may provide a barrier substantially preventing passage of vehicles approaching vehicle barrier deployment system (1) from either direction. If a vehicle strikes deployment posts (100) and/or chains (11), deployment posts (100) and/or chains (11) may quickly bring such a vehicle to a stop. As described above, deployment posts (100) and/or braces (7) may break away from floor (104) of housing (4) at shear bearing joints (21, 28) upon impact of a vehicle with deployment posts (100) and/or chains (11). Despite such breakaway, chains (11) may themselves bring the vehicle to a halt. Alternatively, if a vehicle does not strike deployment posts (100) and/or chains (11), and if deployment of deployment posts (100) is no longer desired, deployment posts may be retracted back into housing (4) as described above, and cover plate (5) may be closed as described above to once again permit passage of vehicular traffic.

In another exemplary use, vehicle barrier deployment system (1) is installed behind a gate (not shown) that it is used to selectively restrict access to a road, driveway, or the like. Vehicle barrier deployment system (1) may therefore provide reinforcement or a "back up" for existing barriers (e.g., where existing barriers are less able to prevent passage of a moving vehicle intent on passing through the barrier). Of course, vehicle barrier system (1) may be used in a variety of other contexts and for a variety of other purposes.

Control of vehicle barrier deployment system (1) may be provided in a variety of ways. In some embodiments, control is provided locally. For instance, a switchbox or other device may be located proximate to vehicle barrier deployment system (1) to permit selective activation of winch (17). Such a switchbox may include any of a variety of security features, including but not limited to keyed control, a card reader, a keypad for entry of a code, a biometrics reader, or any other suitable security feature. Vehicle barrier deployment system (1) may also be triggered by an in-road sensor or other device. Furthermore, vehicle barrier deployment system (1) may be capable of manual operation, such as in the case of a power loss or under other circumstances.

In other embodiments, control is provided remotely. For instance, winch (17) may be in communication with a network, such that a user may selectively activate winch (17) from a remote location, via wire or wirelessly. Such a network may be a dedicated closed network, the Internet, or any other communication structure. It will be appreciated that any of the security features noted above with respect to local control of vehicle barrier deployment system (1) may also be implemented for remote control of vehicle barrier deployment system (1). It will also be appreciated that one vehicle barrier deployment system (1) may be in communication with one or more other vehicle barrier deployment systems (1). For instance, one vehicle barrier deployment system (1) may act as a "master" system, such that other vehicle barrier deployment systems (1) will automatically deploy or retract in response to deployment or retraction of the "master" system. Alternatively, one vehicle barrier deployment system (1) may act as a relay for data or commands to and/or from other vehicle barrier deployment systems (1). To the extent that a vehicle barrier deployment system (1) is in communication with some type of network, operational data may be communicated to a remote location via the network. For instance, the charge left in battery (40), the operability of winch (17), the presence of water or debris in housing (4), the striking of deployment posts (100) and/or chains (11) by a vehicle, or any other type of data may be communicated via a network. Still other ways in which vehicle barrier deployment system (1) may be controlled or monitored will be apparent to those of ordinary skill in the art.

Figure 6:
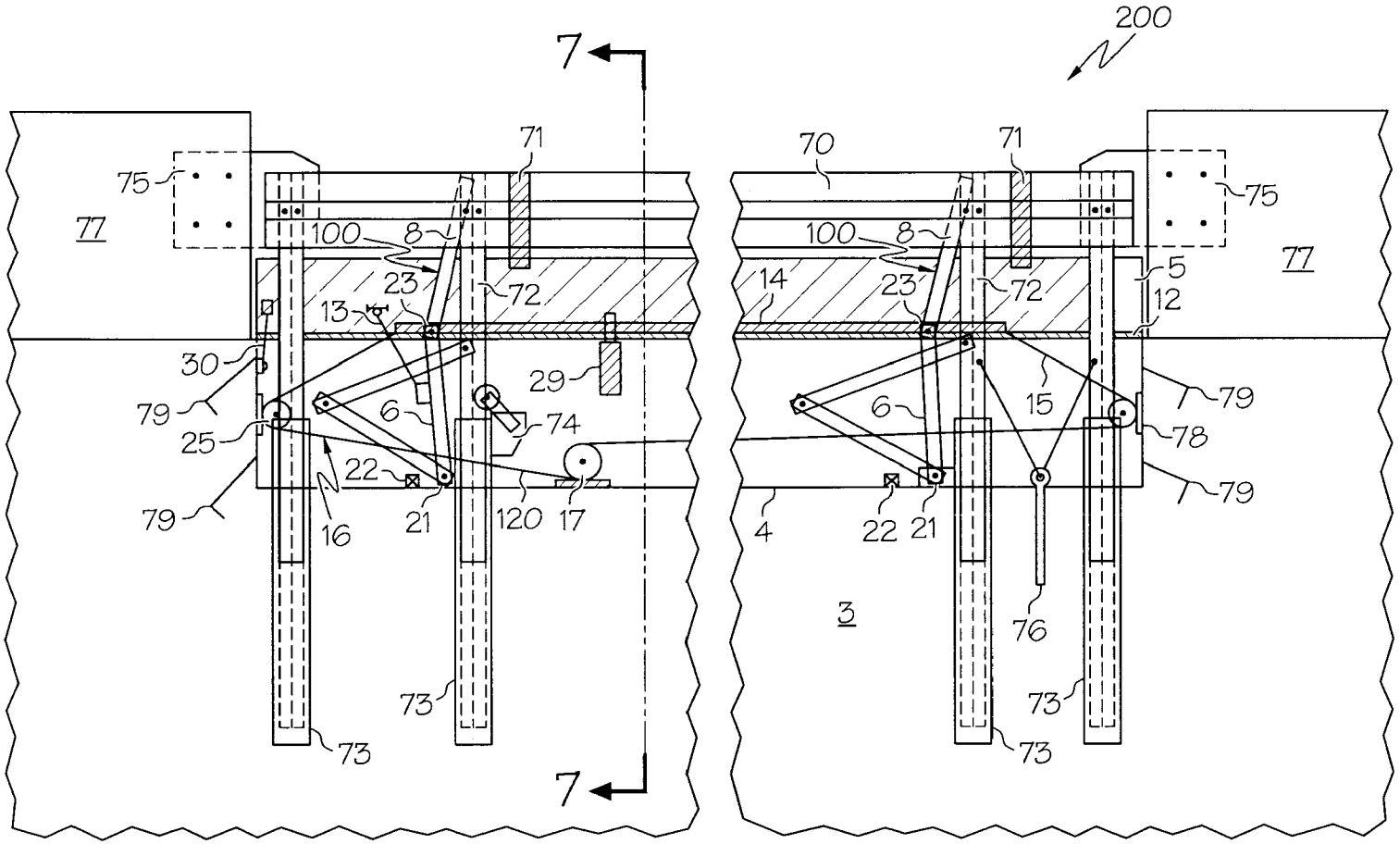
FIG. 6 depicts a cross-sectional view, taken along a longitudinal plane, of an exemplary alternative vehicle barrier deployment system.
Figure 7:
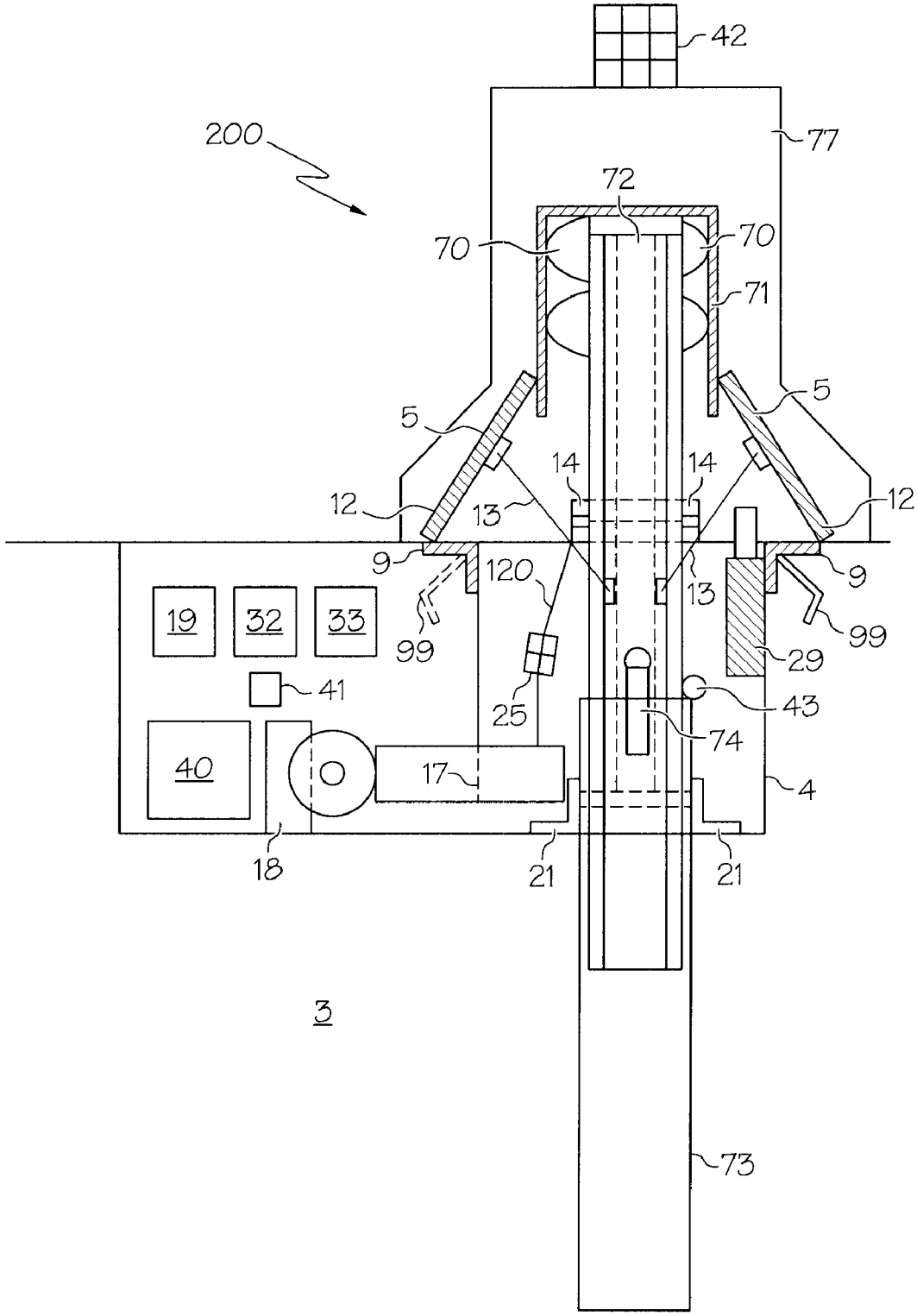
FIG. 7 depicts a cross-sectional view of the vehicle barrier deployment system of FIG. 6, taken along line 7-7 of FIG. 6.

Another exemplary vehicle barrier deployment system (200) is shown in FIGS. 6-7. Like vehicle barrier deployment system (1), vehicle barrier deployment system (200) comprises a housing (4); a cover plate (5); a cover plate rotation limiting chain (30); folding deployment posts (100) that are secured to shear bearing joints (21) and a deployment bar (14); post resting blocks (22); a winch (17); a cable (120); an electrical junction box (19); a transformer (32); a DC/AC inverter (33); a battery (40); a battery charger (41); a solar panel (42); a limit switch (43); a sump pump (18); and curb angles (9). These components may be configured and operable in a manner similar to the configuration and operability of such components as described above with respect to vehicle barrier deployment system (1). Similarly, these components may be substituted, supplemented, omitted, or varied in any suitable fashion.

In contrast to vehicle barrier deployment system (1) as described above, vehicle barrier deployment system (200) has a guardrail (70) that is secured to posts (72) (in lieu of having chains (11)). A plurality of guide tubes (73) extend downwardly from housing (4). Posts (72) are configured to reciprocate within guide tubes (73) to provide selective deployment of deployment posts (100) and guard rail (70). While four posts (72) are shown, it will be appreciated that any other suitable number of posts (72) may be used. In the present example, posts (72) are anchored by a restraint (76).

Cable (120) comprises a deployment portion (15) and a retraction portion (16). Deployment portion (15) is secured to one end of deployment bar (14); while retraction portion (16) is secured to the other end of deployment bar (14). A post retraction pulley (25) is secured to one sidewall (102) of housing (4); while a post deployment pulley (78) is secured to the other sidewall (102) of housing (4). Retraction portion (16) of cable (120) is fed around post retraction pulley (25); while deployment portion (15) of cable (120) is fed around post deployment pulley (78).

It will be appreciated that deployment posts (100) may be selectively moved between a deployed, upright configuration and a retracted, folded configuration by operation of winch (17) in a manner similar to that described above with respect to vehicle barrier deployment system (1). In particular, when winch (17) is rotated clockwise (with reference to FIG. 6), deployment portion (15) of cable (120) will pull on deployment bar (14) in a manner sufficient to cause the deployment posts (100), which are each pivotally secured to deployment bar (14), to unfold and extend upwardly to a deployed configuration. When winch (17) is rotated counterclockwise (with reference to FIG. 6), retraction portion (16) of cable (120) will pull in the opposite direction on deployment bar (14) in a manner sufficient to cause deployment posts (100) to retract and fold downwardly to a retracted configuration. As noted above, rotation of winch (17) (e.g., in the clockwise and/or counterclockwise direction) may be regulated by one or more limit switches (43) or any other suitable component (s). In this example, deployment bar (14) is coupled with each deployment post (100) with a pinned joint splice plate (23) at the joint separating upper portion (8) and lower portion (6). Of course, deployment posts (100) may be deployed and retracted in any other suitable fashion using any other suitable structures or techniques.

In the present example, upper portion (8) of each deployment post (100) is pivotally secured to guardrail (70). Accordingly, upward deployment of deployment posts (100) will cause guardrail (70) to raise up and out of housing (4). Likewise, when deployment posts (100) are retracted into housing (4), guardrail (70) will also be lowered back into housing (4). Posts (72) will reciprocate within guide tubes (73) during such upward and downward movement of guardrail (70). Guide tubes (73) may substantially restrict horizontal movement of guardrail (70). One or more guide brackets (74) may be secured to guide tubes (73) or to sidewall (102) of housing (4) to provide a guide for reciprocating posts (72).

As shown in FIG. 7, vehicle barrier system (200) comprises a pair of cover plates (5). A lift assist spring (29) is secured to each longitudinal sidewall (102), adjacent to each cover plate (5). Each lift assist spring (29) is biased to urge its corresponding cover plate (5) upward. As shown in FIGS. 6-7, a plurality of cover plate opening brackets (71) are secured to guardrail (70). Cover plate opening brackets (71) are configured such that, when deployment posts (100) are extended to a deployed configuration, cover plate opening brackets (71) engage each cover plate (5), and thus open cover plates (5) with assistance from lift assist springs (29).

Since braces (7) are omitted in the vehicle barrier system (200) of the present example, cover plate retraction chain (13) is coupled with lower portion (6) of a deployment post (100). Accordingly, as deployment posts (100) are pulled downward to a retracted, folded configuration, lower portion (6) of deployment post (100) may pull cover plate retraction chain (13), thereby pulling cover plate (5) closed. Other suitable structures and techniques for opening and closing cover plates (5) will be apparent to those of ordinary skill in the art. It will also be appreciated that vehicle barrier system (200) may be modified to have only one cover plate (5), an outright substitute for one or more cover plates (5), or no cover plate at all. For instance, the top of guardrail (70) may be configured to provide a functional equivalent of cover plates (5) when deployment posts (100) are in a retracted configuration. Other variations will be apparent to those of ordinary skill in the art.

In one merely exemplary use of vehicle barrier system (200), vehicle barrier system (200) is positioned in a median of a multi-lane highway or interstate, between a pair of pre-existing median barriers (77). Guide plates (75) may be mounted to median barriers (77) in order to guide or reinforce guardrail (70). In this example, vehicle barrier system (200) is oriented substantially parallel to the flow of traffic on a roadway, and is configured to restrict passage across a highway median rather than restricting passage across a lane of a roadway. It will be appreciated that having vehicle barrier system (200) in such a location may be useful for emergency vehicles that need to cross the median of a highway or interstate, etc., who may otherwise need to travel substantial distances out of the way just to get to the other side of the highway. Furthermore, vehicle barrier system (200) may be installed where gaps already exist between median barriers (77) (e.g., where such gaps were created for use by patrol cruisers or emergency vehicles), and may be set in a deployed configuration by default to prevent unauthorized use of such gaps by non-state and non-emergency vehicles, such that guardrail (70) may be lowered when authorized vehicles need to cross the median. Of course, vehicle barrier system (200) may be used in a variety of other contexts and for a variety of other purposes.

It will also be appreciated that vehicle barrier system (200) may be subject to local or remote control and/or monitoring in any manner similar to the control options described above with respect to vehicle barrier system (1). For instance, referring back to the emergency personnel example, one or more dispatchers may be provided with remote control of vehicle barrier system (200). In addition or in the alternative, emergency vehicle drivers may be provided with remote control of vehicle barrier system (200). Other ways in which vehicle barrier system (200) may be controlled or monitored will be apparent to those of ordinary skill in the art.

Figure 8:
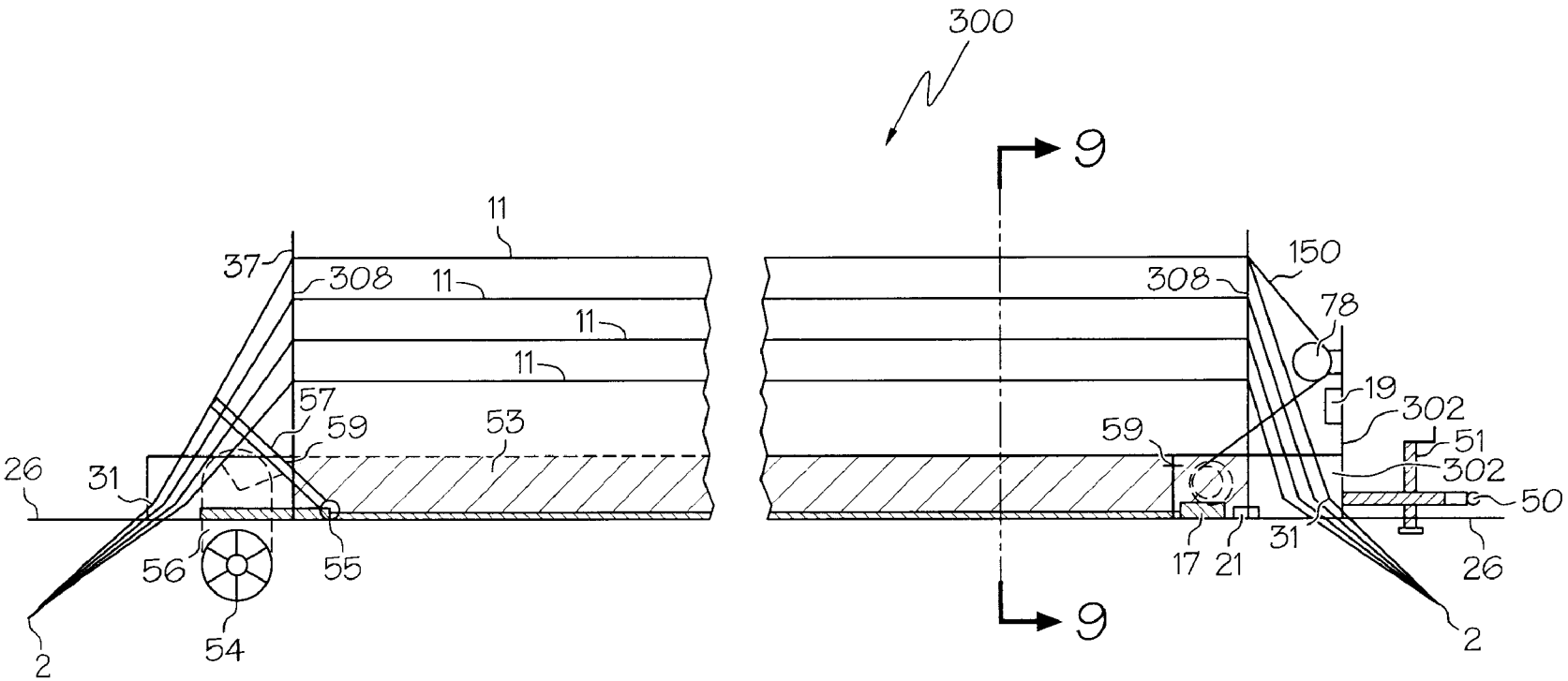
FIG. 8 depicts a cross-sectional view, taken along a longitudinal plane, of another exemplary alternative vehicle barrier deployment system.
Figure 9:
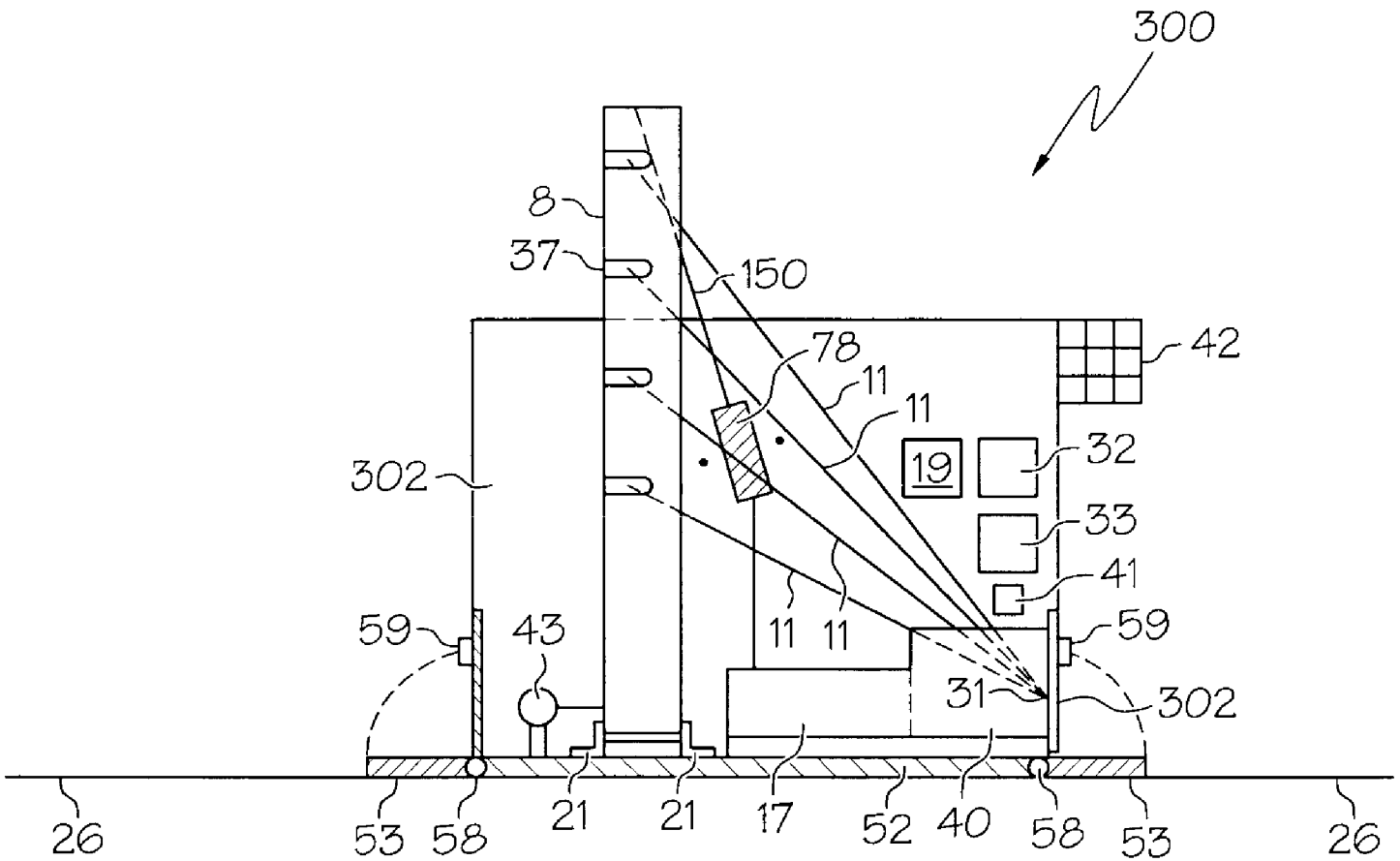
FIG. 9 depicts a cross-sectional view of the vehicle barrier deployment system of FIG. 8, taken along line 9-9 of FIG. 8.

Yet another exemplary vehicle barrier deployment system (300) is shown in FIGS. 8-9. In this example, vehicle barrier deployment system (300) is mobile. Vehicle barrier deployment system (300) comprises a base plate (52) and sidewalls (302) extending vertically upward from portions of base plate (52). A trailer hitch (50) is secured relative to base plate (52) to permit vehicle barrier deployment system (300) to be coupled with a movable vehicle. A lifting jack (51) is provided near trailer hitch (50) to provide support for base plate (52) when vehicle barrier deployment system (300) is being coupled with a vehicle. A pair of retractable rear wheels (54) are provided at the opposite end of base plate (52). In particular, each rear wheel (54) is mounted to a support (57), which is pivotally engaged with base plate (52) at a hinge (55). The pivotal engagement of support (57) with base plate (52) permits rear wheel to be moved upward, thereby permitting the bottom surface of base plate (52) to rest directly on roadway (26). Otherwise, during transit of vehicle barrier deployment system (300), rear wheels (54) may be kept in a downward position by a pin (56) that may be inserted to prevent support (57) from pivoting relative to base plate (52). Alternatively, any other suitable components may be used to provide retractability of rear wheels (54), including but not limited to a motor or actuator (e.g., a hydraulic actuator, etc.) to move rear wheels (54) upward or downward relative to base plate (52).

Vehicle barrier deployment system (300) has a winch (17), an electrical junction box (19), a transformer (32), a DC/AC inverter (33), a battery (40), a battery charger (41), a solar panel (42), and a limit switch (43), much like vehicle barrier deployment systems (1, 200). In this example, however, vehicle barrier deployment system (300) lacks jointed deployment posts (100). Instead, vehicle barrier deployment system (300) has deployment posts (308), which are structurally identical to upper portion (8) of vehicle deployment posts (100) described above with respect to vehicle barrier deployment system (1). In particular, deployment posts (308) each have a plurality of chain engagement notches (37), into which links of chain (11) may be inserted. Furthermore, a chain retention member (not shown in FIGS. 8-9) may be secured to deployment posts (308) to prevent chain (11) from sliding laterally out of chain engagement notches (37). Deployment posts (308) are secured to base plate (52) by shear bearing joints (21), such that deployment posts (308) may "break away" from base plate in a manner similar to the "breaking away" of deployment posts (100) from floor (102) of housing (4) described above with respect to vehicle barrier deployment system (1). Deployment posts (308) are spaced such that, when deployment posts (308) are deployed to an upright position, the distance between deployment posts (308) is approximately equal to the width of roadway (26). Of course, any other suitable dimensions may be used.

In another embodiment, deployment posts (308) are substituted with deployment posts (100) described above with respect to FIGS. 1-7. Accordingly, it will be appreciated that any suitable substitutions or rearrangements of components may be made among the various embodiments described herein Winch (17) of the present example is coupled with a deployment cable (150), which is secured to a deployment post (308) after passing through a deployment pulley (78) that is secured to a sidewall (302). Referring specifically to FIG. 8, counterclockwise rotation of winch (17) will pull cable (150), which will in turn pull deployment post (308). Such pulling of deployment post (308) will cause deployment post (308) to rotate upward to an upright position. As noted above, rotation of winch (17) (e.g., in the clockwise and/or counterclockwise direction) may be regulated by one or more limit switches (43) or any other suitable component(s). With chains (11) being engaged with deployment posts (308) and being operable to transmit a pulling force, the pulling of one deployment post (308) will effect a pulling of the other deployment posts (308), thereby causing all deployment posts (308) in this example to be raised to an upright, deployed position. In another embodiment, only the deployment post (308) that is closest to winch (17) is raised by winch (17). In such an embodiment, one or more other deployment posts (308) may be substantially fixed in an upright position, even during transport of vehicle barrier deployment system (300). Alternatively, one or more deployment posts (308) may be raised "manually" (e.g., without the assistance of winch (17) or some other component).

In the present example, when winch (17) is rotated clockwise, the weight of chains (11) may cause deployment posts (308) to rotate back downward to a retracted position, where deployment posts (308) rest substantially flat against base plate (52). Alternatively, deployment posts (308) may be retracted "manually" (e.g., by a person simply pushing deployment posts (308) down) or using any suitable structures, devices, or techniques.

Chains (11) in this example pass through chain exit openings (31) formed through sidewalls (302). Chains (11) are also configured to be secured within the ground via anchors (2). For instance, chains (11) may be secured within the ground via anchors (2) after deployment posts (308) have been deployed to an upright configuration, or at any other suitable time. In another embodiment, a concrete "deadman" (not shown) is provided above ground as each anchor (2). In yet another embodiment, a preexisting local structure such as a tree (not shown) is used for each anchor (2). In still another embodiment, another vehicle (not shown) is used for each anchor (2). Other suitable structures or components that may be used to provide anchors (2) for chains (11) will be apparent to those of ordinary skill in the art.

Vehicle barrier deployment system (300) of the present example further comprises rotatable stability plates (53), each being mounted to base plate (52) by a corresponding hinge (58). Stability plates (53) may provide depth and structural stability to vehicle barrier deployment system (300) during transport of vehicle barrier deployment system (300), such as by resisting bouncing of base plate (52) that may otherwise occur during transport of vehicle barrier deployment system (300). As shown, stability plates (53) may be rotated upward and secured to sidewalls (302) by a locking pin (59) during transit of vehicle barrier deployment system (300); and may be rotated downward to provide additional stability to vehicle barrier deployment system (300) when deployment posts (308) have been deployed and base plate (52) is resting directly on the surface of roadway (26). Further components (not shown) may be added to selectively lock stability plates (53) in a deployed configuration.

In an exemplary use of vehicle barrier deployment system (300), vehicle barrier deployment system (300) is secured to a vehicle (not shown) via trailer hitch (50) to permit the vehicle to tow vehicle barrier deployment system (300). During such travel, support (57) is locked in a downward position by pin (56) to maintain contact between rear wheels (54) and roadway (26). Deployment posts (308) are folded down against base plate (52) while vehicle barrier deployment system (300) is in transit. The vehicle drives vehicle barrier deployment system (300) to a selected location on roadway (26), and positions vehicle barrier deployment system (300) across roadway (26), perpendicular to traffic lanes. With vehicle barrier deployment system (300) in position, trailer hitch (50) is removed from the vehicle, and pin (56) is removed to permit support (57) to be swept upward, such that base plate (52) rests directly on roadway (26). Pins (59) are then removed and stability plates (53) are rotated downward, such that stability plates (53) rest directly on roadway (26). In this configuration, vehicle barrier deployment system (300) is configured such that vehicles driving along roadway (26) may simply drive over chains (11) and base plate (52) without being restrained. In another embodiment, small ramps (not shown) are placed along both longitudinal sides of vehicle barrier deployment system (300) to provide a smooth transition from roadway (26) across chains (11) and base plate (52). At a selected time, winch (17) is activated to deploy deployment posts (308), thereby raising chains (11) to provide a barrier in roadway (26). Chains (11) are then secured via anchors (2). In this configuration, chains (11) provide a barrier to prevent passage of vehicles driving along roadway (26). When vehicle barrier deployment system (300) is no longer needed to provide a barrier, the above steps are reversed, and vehicle barrier deployment system (300) is taken to another location by a vehicle. By way of example only, vehicle barrier deployment system (300) may be used by the military to provide checkpoints, by police to provide blockades, or by other persons or entities for a variety of purposes. Other contexts and purposes in which vehicle barrier system (300) may be used will be apparent to those of ordinary skill in the art.

It will be appreciated that vehicle barrier deployment systems (1, 200, 300) described herein may be used to provide a barrier across an entire width of roadway (26). It will also be appreciated that vehicle barrier deployment systems (1, 200, 300) may provide a barrier to vehicles moving in either direction along roadway (26). In other words, a deployed vehicle barrier deployment system (1, 200, 300) may provide a bi-directional barrier. Furthermore, each vehicle barrier deployment system (1, 200, 300) is operable to provide such a barrier with a single drive mechanism (e.g., winch (17)). In many embodiments, the drive mechanism that is used to deploy a barrier is mechanical or electromechanical, such as winch (17) or some other mechanical/electromechanical device. It will be appreciated that, where a mechanical or electromechanical drive mechanism is used, vehicle barrier deployment system (1, 200, 300) may be substantially free of any hydraulic or pneumatic devices. In other words, a drive mechanism need not rely on hydraulics or pneumatics to operate, which may be preferable in certain situations. In other situations, hydraulics or pneumatics may be preferred, and a hydraulic or pneumatic device may be incorporated into a vehicle barrier deployment system (1, 200, 300), either for a drive mechanism or otherwise.

Vehicle barrier deployment systems (1, 200, 300) have been described herein as deploying chains (11) or guardrail (70) in a manner that does not require a sweeping motion that is transverse to a longitudinal plane defined by vehicle barrier deployment systems (1, 200, 300). Instead, the only sweeping motion for deployment of chains (11) in vehicle barrier deployment systems (1, 300) is along a longitudinal plane defined by vehicle barrier deployment systems (1, 300). With respect to vehicle barrier deployment system (200), guardrail (70) simply moves up and down along the longitudinal plane defined by vehicle barrier deployment system (200) during deployment and retraction of guardrail (70). It will be appreciated that the absence of transverse sweeping of chains (11) or guardrail (70) for deployment of chains (11) or guardrail (70) permit each vehicle barrier deployment system (1, 200, 300) to occupy a relatively short portion of a lane of roadway (26). Such a narrow profile of each vehicle barrier deployment system (1, 200, 300) may be best seen in FIGS. 2, 7, and 9, respectively. Those of ordinary skill in the art will recognize that the narrow profile achieved by relying on deployment motion that is along a longitudinal plane of vehicle barrier deployment system (1, 200, 300) (and therefore transverse to roadway (26)) may ease installation of vehicle barrier deployment systems (1, 200, 300) or provide other benefits. Alternatively, a vehicle barrier deployment system (1, 200, 300) may be modified to have a deployment motion that spans across any other suitable plane, including those transverse to a longitudinal plane defined by vehicle barrier deployment system (1, 200, 300).

While each vehicle barrier deployment system (1, 200, 300) has been described as being capable of spanning across an entire width of roadway (26), it will be appreciated that vehicle barrier deployment system (1, 200, 300) may span across any other suitable length. For instance, a vehicle barrier deployment system (1, 200, 300) may span across only one lane of traffic. Alternatively, any vehicle barrier deployment system (1, 200, 300) may be configured to span across distances that far exceed the width of roadway (26). For instance, a vehicle barrier deployment system (1, 200, 300) may be constructed to span across the entire width of the face of a building, park, or other location, or may be constructed to span around the entire perimeter of such a location. It will be appreciated that, in many situations, length may be added to a vehicle barrier deployment system (1, 200, 300) simply by lengthening chains (11) or guardrail (70), and possibly adding additional posts (100, 72, 308). Furthermore, in many situations, all posts (100, 72, 308) may still be deployed by a single drive mechanism (e.g., winch (17)). In addition, any of vehicle barrier deployment systems (1, 200, 300) described herein may be modified in accordance with embodiments disclosed in U.S. Provisional Patent Application Ser. No. 60/799,439, entitled "Vehicle Barrier Deployment System," filed May 10, 2006, the disclosure of which is incorporated by reference herein in its entirety. Still other modifications of vehicle barrier deployment systems (1, 200, 300) and their uses will be apparent to those of ordinary skill in the art.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. A vehicle barrier deployment system, comprising:

(a) a base member, wherein the base member is recessed below a road surface;

(b) at least two lifting members pivotally secured to the base member, wherein the at least two lifting members are operable to be selectively raised and lowered in a vertical direction relative to the base member, wherein the at least two lifting members are located below the road surface when the at least two lifting members are in a lowered position;

(c) at least one barrier member non-resiliently secured relative to the ground, wherein the at least one barrier member is in communication with the at least two lifting members, wherein the at least one barrier member is selected from the group consisting of cables and chains, wherein the at least one barrier member is configured to stop a moving vehicle when the at least two lifting members are in a raised position, wherein the at least one barrier member is located below the road surface when the at least two lifting members are in the lowered position; and (d) an actuation assembly in communication with the at least two lifting members, wherein the actuation assembly is operable to selectively raise and lower the at least two lifting members by moving at least a portion of each of the at least two lifting members in a direction that is transverse to a traffic lane.

2. The vehicle barrier deployment system of claim 1, wherein each of the at least two lifting members comprise a folding deployment post, wherein the folding deployment post comprises an upper portion and a lower portion, wherein the upper portion is configured to pivot relative to the lower portion.

3. The vehicle barrier deployment system of claim 2, wherein the lower portion of each folding deployment post is pivotally secured to the base member.

4. The vehicle barrier deployment system of claim 3, wherein the lower portion of each folding deployment post is pivotally secured to the base member by a corresponding shear bearing joint.

5. The vehicle barrier deployment system of claim 4, wherein at least a portion of each shear bearing joint is configured to break upon impact of a moving vehicle with at least one of the at least two lifting members or the at least one barrier member.

6. The vehicle barrier deployment system of claim 2, wherein the upper portion of each deployment post is in pivotal engagement with the at least one barrier member.

7. The vehicle barrier deployment system of claim 1, wherein each of the at least two lifting members comprises a plurality of slots, wherein each of the slots is configured to receive a portion of a corresponding chain of the plurality of chains.

8. The vehicle barrier deployment system of claim 1, wherein the actuation assembly comprises a winch and a cable, wherein the cable is in communication with the at least two lifting members.

9. The vehicle barrier deployment system of claim 8, further comprising at least one pulley, wherein the pulley is positioned along the cable between the winch and at least one of the at least two lifting members.

10. The vehicle barrier deployment system of claim 8, wherein the winch is operable to actively raise the at least two lifting members when the winch is rotated in a first direction, wherein the winch is operable to actively lower the at least two lifting members when the winch is rotated in a second direction.

11. The vehicle barrier deployment system of claim 1, further comprising a housing, wherein the housing is configured to be embedded within the ground.

12. The vehicle barrier deployment system of claim 11, further comprising a cover plate, wherein the cover plate is configured to selectively cover the at least two lifting members and the at least one barrier member when the at least two lifting members are lowered within the housing.

13. The vehicle barrier deployment system of claim 12, wherein the cover plate is configured to rotate relative to the housing along a first plane of rotation, wherein each of the at least two lifting members is configured to rotate relative to the base member along a second plane of rotation, wherein the second plane of rotation is perpendicular to the first plane of rotation.

14. A vehicle barrier deployment system, comprising:

(a) a base member, wherein the base member defines a longitudinal plane that is perpendicular to the ground, wherein the base member is recessed below the ground surface;

(b) at least two lifting members pivotally secured to the base member, wherein the at least two lifting members are operable to be selectively raised and lowered in a vertical direction relative to the base member;

(c) at least one barrier member, wherein the at least one barrier member is selected from the group consisting of chains and cables, wherein the at least one barrier member is in communication with the at least two lifting members, wherein the at least one barrier member is configured to non-resiliently stop a moving vehicle when the at least two lifting members are in a raised position, wherein the at least one barrier member is positioned below the ground surface when the at least two lifting members are in a lowered position; and (d) an actuation assembly in communication with the at least two lifting members, wherein the actuation assembly is operable to selectively raise and lower the at least two lifting members by causing at least a portion of each of the at least two lifting members to sweep along the longitudinal plane perpendicular to the ground.

15. A method of providing a vehicle barrier across at least one lane of a roadway, the roadway having a surface, the method comprising:

(a) providing a pair of pivoting lifting members, wherein each of the pivoting lifting members are oriented in a direction transverse to the path of vehicles traveling along a lane of a roadway, wherein the pivoting lifting members are positioned below the surface of the roadway;

(b) providing at least one barrier member in communication with the pair of pivoting lifting members, wherein the at least one barrier member spans across the width of at least one lane of the roadway, wherein the at least one barrier member is selected from the group consisting of cables and chains, wherein the at least one barrier member is positioned below the surface of the roadway;

(c) providing an actuation assembly in communication with the pair of lifting members, wherein the actuation assembly is operable to cause the pair of pivoting members to pivot, to thereby raise the at least one barrier member relative to the ground; and (d) activating the actuation assembly to pivot the pair of pivoting members relative to the ground, thereby raising the at least one barrier member relative to the ground, wherein the act of activating the actuation assembly comprises:

(i) raising a portion of the pivoting lifting members above the roadway surface, and (ii) raising the at least one barrier member above the roadway surface.

* * * * *